US006910834B2

(12) United States Patent
Harbaugh et al.

(10) Patent No.: US 6,910,834 B2
(45) Date of Patent: Jun. 28, 2005

(54) MINE PROP

(75) Inventors: William L. Harbaugh, Greensburg, PA (US); Charles C. Lash, Apollo, PA (US)

(73) Assignee: Burrell Mining Products, Inc., New Kensington, PA (US)

( * ) Notice: Subject to any disclaimer, the term of this patent is extended or adjusted under 35 U.S.C. 154(b) by 0 days.

(21) Appl. No.: 10/854,356

(22) Filed: May 26, 2004

(65) Prior Publication Data

US 2004/0240948 A1 Dec. 2, 2004

Related U.S. Application Data

(60) Provisional application No. 60/473,580, filed on May 27, 2003.

(51) Int. Cl.[7] ..... E21D 15/00; E04G 25/00

(52) U.S. Cl. ..... 405/288; 405/290; 405/292; 405/301; 248/351; 248/354.2; 248/357; 299/11; 299/31

(58) Field of Search ..... 405/288, 290, 405/291–294, 301; 248/351, 354.1, 354.2, 357; 299/11, 31

(56) References Cited

U.S. PATENT DOCUMENTS

| | | | | | |
|---|---|---|---|---|---|
| 4,052,029 | A | * | 10/1977 | Townsend | 248/548 |
| 4,167,361 | A | * | 9/1979 | Petro et al. | 405/290 |
| 4,192,479 | A | | 3/1980 | Friebe et al. | |
| 4,255,071 | A | * | 3/1981 | Koppers et al. | 405/290 |
| 4,277,204 | A | * | 7/1981 | Koppers et al. | 405/288 |
| 4,281,487 | A | * | 8/1981 | Koller | 248/351 |
| 4,520,980 | A | | 6/1985 | Townsend | |
| 4,534,531 | A | * | 8/1985 | Brown | 248/351 |
| 4,915,339 | A | | 4/1990 | Halbich | |
| 5,051,039 | A | | 9/1991 | Heiliger | |
| 5,308,196 | A | | 5/1994 | Frederick | |
| 5,413,436 | A | * | 5/1995 | Merz | 405/290 |
| 5,669,739 | A | * | 9/1997 | Clarke | 405/289 |
| 5,720,581 | A | * | 2/1998 | Bacon et al. | 405/290 |
| 5,868,527 | A | * | 2/1999 | King et al. | 405/290 |
| 5,921,718 | A | * | 7/1999 | Kolk | 405/290 |
| 6,196,635 | B1 | * | 3/2001 | Rohaly et al. | 299/11 |
| 6,394,707 | B1 | * | 5/2002 | Kennedy et al. | 405/288 |
| 2002/0136607 | A1 | * | 9/2002 | Merz | 405/288 |

FOREIGN PATENT DOCUMENTS

| | | |
|---|---|---|
| CN | 95107473 | 1/1996 |
| EP | 0 128 964 | 6/1983 |
| EP | 0 160 133 | 4/1984 |

(Continued)

OTHER PUBLICATIONS

Yield test report, conducted by NIOSH Safety S tructures Testing Laboratory for Jennmar Corporation, relating to Big John™ Yield Props—dated Feb. 5, 2002.

Product information brochure produced by Burrell Mining Products International, Inc. for "The Can© Cribbing System.".

Product information sheet produced by Strata Products (USA), Inc. For "Propsetter© Yieldable Support System.".

*Primary Examiner*—Jong-Suk (James) Lee
(74) *Attorney, Agent, or Firm*—Morriss O'Bryant Compagni, P.C.

(57) ABSTRACT

A mine prop is comprised of an elongate tube having a slenderness ratio that would generally allow buckling or kneeling of the elongate tube when exposed to a sufficient axial force. A plurality of elongate support members having a length less than the elongate tube are attached to the tube to prevent buckling or kneeling of the elongate tube along the portion of the tube to which the elongate support members are attached. The portions of the tube that are unsupported by the elongate support members define one or more yieldable zones proximate at least one end of the tube. A compressible filler material is disposed within at least portion of the tube to support yielding in the yieldable zone.

36 Claims, 17 Drawing Sheets

FOREIGN PATENT DOCUMENTS

| | | | |
|---|---|---|---|
| GB | 2 081 340 | | 7/1981 |
| GB | 2070666 | * | 9/1981 |
| GB | 2 125 465 | | 4/1983 |
| GB | 2 149 440 | | 11/1983 |
| GB | 2 330 596 | | 10/1998 |
| WO | WO-01/14692 | | 3/2001 |
| ZA | 77/5286 | | 8/1977 |
| ZA | 77/5348 | | 9/1977 |
| ZA | 78/4964 | | 8/1978 |
| ZA | 78/5331 | | 9/1978 |
| ZA | 78/4881 | | 5/1979 |
| ZA | 80/2821 | | 5/1980 |
| ZA | 80/4801 | | 8/1980 |
| ZA | 80/5978 | | 9/1980 |
| ZA | 80/6817 | | 11/1980 |
| ZA | 81/2905 | | 5/1981 |
| ZA | 81/4868 | | 7/1981 |
| ZA | 81/4869 | | 7/1981 |
| ZA | 81/5000 | | 7/1981 |
| ZA | 81/5001 | | 7/1981 |
| ZA | 81/5002 | | 7/1981 |
| ZA | 81/5085 | | 7/1981 |
| ZA | 81/5169 | | 7/1981 |
| ZA | 81/5170 | | 7/1981 |
| ZA | 83/6147 | | 8/1983 |
| ZA | 83/6286 | | 8/1983 |
| ZA | 83/8402 | | 11/1983 |
| ZA | 83/8403 | | 11/1983 |
| ZA | 84/7218 | | 9/1984 |
| ZA | 84/7219 | | 9/1984 |
| ZA | 85/2380 | | 3/1985 |
| ZA | 86/0723 | | 1/1986 |
| ZA | 87/7215 | | 9/1987 |
| ZA | 90/1210 | | 2/1990 |
| ZA | 90/1984 | | 3/1990 |
| ZA | 92/7149 | | 9/1992 |
| ZA | 93/3156 | | 5/1993 |
| ZA | 96/1864 | | 3/1996 |
| ZA | 97/4419 | | 5/1997 |
| ZA | 97/7556 | | 8/1997 |
| ZA | 97/8946 | | 10/1997 |
| ZA | 98-4887 | | 6/1998 |
| ZA | 2000/1460 | | 3/2000 |
| ZA | 2000/2789 | | 6/2000 |
| ZA | 2002/9937 | | 12/2002 |

* cited by examiner

MINE PROP

CROSS-REFERENCE TO RELATED APPLICATION

The present application claims priority to U.S. Provisional Patent Application Ser. No. 60/473,580, filed on May 27, 2003.

BACKGROUND

1. Field of the Invention

The present invention relates generally to an underground mine prop for supporting the roof, and, more particularly, to a yieldable mine prop that provides controlled yielding along a length thereof while preventing buckling failure of the mine prop when subjected to longitudinal forces.

2. Description of the Prior Art

Over the past several years, Burrell Mining Products, Inc. of New Kensington, Pa. has successfully marketed and sold a mine roof support product sold under the trademark THE CAN®." THE CAN support is comprised of an elongate metal shell that is filled with aerated concrete. The use of aerated concrete in THE CAN support allows the support to yield axially in a controlled manner that prevents sudden collapse of an underground mine roof.

THE CAN support has a height to width ratio (i.e., slenderness ratio) that prevents the support from buckling along its axial length. The slenderness ratio of a column having a circular cross-section is defined by the length of the column divided by the radius. Because THE CAN has a typical slenderness ratio of between about 5 and 10 for most sizes of THE CAN, THE CAN yields axially before it buckles or kneels. As such, THE CAN support yields axially as the aerated concrete within the product is crushed and maintains support of a load as it yields.

A typical size of THE CAN support is approximately six feet (1.8 meters) in height and two feet (0.6 meters) in diameter. This results in approximately 18.85 cubic feet (0.51 cubic meters) of aerated concrete contained within each support. As such, even using aerated concrete, the weight of the aerated concrete and its associated metal shell results in a product that typically requires various machinery, such as a fork lift, to move each support. In addition, the general sizes of THE CAN supports somewhat limits its use to certain mine applications, such as longwall mining operations where the size of THE CAN support does not interfere with the mining operations. While being extremely successful in those mines that can utilize THE CAN support, there still exists a need in the industry to provide a mine prop that has potential applicability to every underground mining operation, or tunnel type environment for that matter, that can be carried by hand by the user.

By contrast, an oak wood post having a length of 6.5 feet and a diameter of 6 inches will have a slenderness ratio of 26. Such a post will have a maximum axial load handling capability (assuming that the load is not applied eccentrically) of about 16,000 lbs. For a post formed from spruce, the maximum safe axial load handling capability for a post that is 6.5 feet in length and 6 inches in diameter is about 13,600 pounds. In addition, when a wood post yields by kneeling or buckling, such yielding will result in catastrophic failure of the post in which the post can no longer support the load.

Because of the obvious problem associated with such catastrophic failure of posts, various mine props have been developed in the art for supporting the roof of an underground mine. Such mine props have included, for example various configurations of wood beams encased in metal housings, and complex hydraulically controlled prop devices. Such props, however, do not allow for controlled axial yielding while preventing sideways buckling or kneeling in a simple, lightweight prop that can be hand carried by a user.

Thus, it would be advantageous to provide a mine prop that is relatively lightweight so that it can be hand carried to a desired location, that can yield upon itself without kneeling or buckling, is relatively easy to manufacture and cost effective, and can be utilized in virtually any underground mining situation where such a prop may be desired.

SUMMARY OF THE INVENTION

These and other advantages will become apparent from a reading of the following summary of the invention and description of the illustrated embodiments in accordance with the principles of the present invention. Accordingly, a support prop is comprised of an elongate tube containing a crushable or compressible core material that allows controlled yielding of the support prop along its length. The support prop is laterally strengthened along a portion thereof, primarily along a center portion thereof, so as to prevent lateral buckling of the support prop under load. More specifically, the support prop is designed to yield axially before compressive forces in the center portion of the support prop reach a buckling threshold or limits. This is accomplished by providing lateral support members along a length of the elongate tube or shell of the support prop while leaving the ends of the support prop unsupported by the lateral support members. Thus, crush zones or regions are formed at one or both ends of the support prop to allow the support prop to axially compress in these crush regions while being laterally supported to prevent buckling of the support prop.

In one embodiment, the support prop is comprised of an outer steel shell formed in the shape of an elongate tube. An aerated or other lightweight concrete or cement is poured into the elongate tube to substantially fill the entire length of the tube. Once the concrete is set, the concrete will bond to the inside surface of the tube so as to prevent the concrete from disengaging from the tube during use. A plurality of longitudinally extending support members are attached to the elongate tube along a central portion thereof to provide resistance to buckling of the elongate tube. The portions of the elongate tube that are unsupported by the support members provide yield or crush zones within which the support prop can yield along its length in a relatively controlled manner. The use of a lightweight cement containing lightweight aggregate or air pockets allows the cement to be crushed in the crush zones thus allowing axial yielding of the support prop along its length as the lightweight concrete is compressed.

Because the support prop is designed to be relatively thin and light, it can be carried by hand by one or more persons to a desired location within the mine. As such, handles are provided proximate each end of the support prop according to the present invention to facility such carrying. The handles may be comprised of "C" shaped members that are welded directly to the outer shell of the support prop.

In one embodiment, lateral supports of a support prop in accordance with the present invention are comprised of elongate, flat sections of steel that are longitudinally bent to form a generally "V" shaped member in cross-section. The bend includes a radius to provide a rounded corner that extends the length of the lateral support. Each lateral support is welded along its edges to the outer shell of the support prop. The lateral supports extend along a central portion of the support prop to provide lateral or side-to-side stability for the support prop to prevent buckling, which typically occurs near the center of an elongate member, while leaving one or more end portions of the support prop exposed to allow longitudinal yielding of the mine support as the end portion crush under load.

One end of a support prop according to the present invention may be provided with an end cap that is used during the manufacturing process to contain the filler material within the shell of the support prop. Thus, the end cap is provided at the bottom of the support prop. The end cap also keeps any filler material that becomes crushed under load contained within the outer shell of the support prop, at least on the end where the end cap resides.

A support prop according to the present invention may also be provided with length adjustment. In order to reduce the length of the support prop, a circumferential perforation is provided in the outer shell proximate one or both ends of the support prop. The perforations allow the support prop to be severed at the location of the perforation to shorten the length of the support prop. By laterally striking the support prop proximate the end above the perforation, the sections of the shell between each perforation can be severed thus allowing the end of the support prop above the perforation to be removed.

While the support prop according to the present invention may be comprised of a single filler material throughout the entire length of the support prop, it is also contemplated that the support prop may include other materials therein that have varying densities and thus different compressive strengths. As such, for example, the central portion of the support prop can be internally strengthened by including a more rigid material along the central portion of the support prop while providing yieldable materials at one or both ends of the support prop.

It is further contemplated that a support prop according to the present invention may have various cross-sectional geometries. In each such embodiment, lateral support members are provided along various sides of the support to prevent buckling of the support prop under load.

While the support prop may be formed from a steel shell with steel lateral supports welded to the outside of the steel shell, it is also contemplated that the outer shell and supports may be integrally formed by winding, molding, extruding or other methods to produce a support prop in accordance with the principles of the present invention.

BRIEF DESCRIPTION OF THE DRAWINGS

The foregoing summary, as well as the following detailed description of the illustrated embodiments is better understood when read in conjunction with the appended drawings. For the purpose of illustrating the invention, there is shown in the drawings several exemplary embodiments which illustrate what is currently considered to be the best mode for carrying out the invention, it being understood, however, that the invention is not limited to the specific methods and instruments disclosed.

In the drawings.

DETAILED DESCRIPTION OF THE ILLUSTRATED EMBODIMENTS

Figure 1:
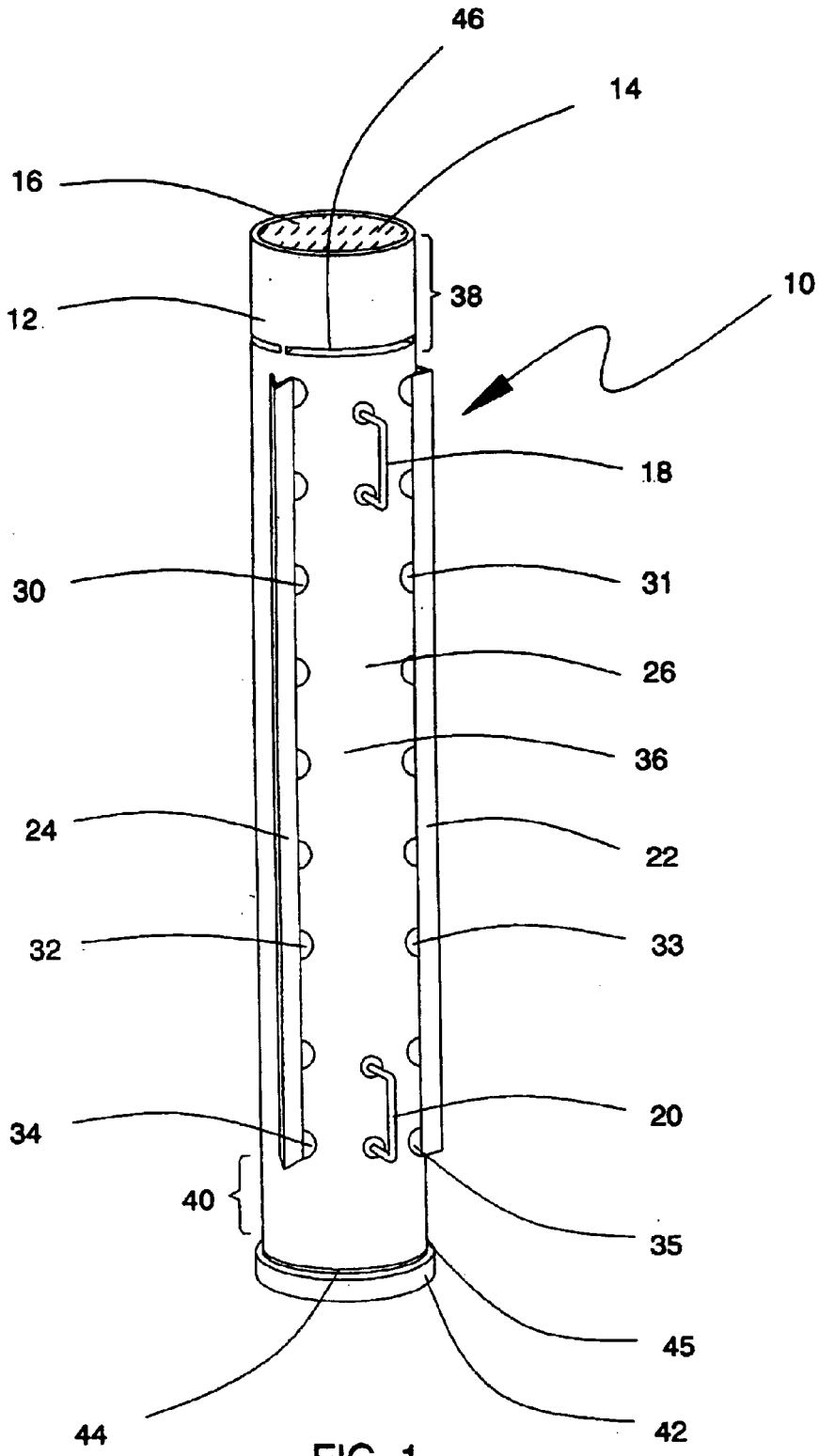
FIG. 1 is a perspective side view of a first embodiment of a support prop in accordance with the principles of the present invention.

FIG. 1 illustrates a support prop, generally indicated at 10 in accordance with the principles of the present invention. The support prop 10 may be utilized in various underground support situations including without limitation underground mine roof support, various tunnel applications and the like. The prop 10 is comprised of an outer shell or tube 12 that defines an inner elongate channel 14 that is filled with a compressible filler material 16 such as aerated concrete or cement or other lightweight concrete, pumas, saw dust, wood or other materials known in the art. The filler material 16 provides the principle load bearing capabilities of the support prop while the outer shell 12 provides secondary longitudinal or load bearing support while also maintaining adequate hoop strength of the mine prop to prevent any significant lateral or radial expansion of the filler material as it is compressed. Thus, the tube 12 and filler material 16 work in tandem as the prop 10 yields under load to allow vertical or longitudinal compression of the prop 10 while maintaining support of the load. That is, the prop 10 will longitudinally yield for a given displacement or yield dimension without catastrophic failure under load.

Aerated or "foamed" concrete or cement is particularly beneficial because it can be cast in the tube 12 substantially along its entire length and the strength or compressibility characteristics of the foamed concrete can be relatively precisely controlled to produce a desired compressive strength to weight ratio. Thus, the foamed concrete can be cast with a compressive strength that is less than the buckling or kneeling limit of the central support portion of the prop.

In addition, once set, foamed concrete will remain contained within the tube 12 during handling and will not settle within the tube, as may be the case when using loose materials, such as saw dust or pumas. In a support application, settling of the filler material 14 is a major concern since any settling will result in larger displacement or yielding of the prop before the prop begins to carry a load. Likewise, unlike a wood post, a load supported by the post 10 is picked up within approximately the first inch (2.5 centimeters). Moreover, unlike wood products, aerated concrete is fire resistant and will therefore not add to the amount of combustible material in an underground environment and is not susceptible to shrinkage.

One of the unique aspects of the prop 10 is that it is light enough to allow for hand carrying by one or more users to a desired site location for installation. As such, handle members 18 and 20 are attached, as by welding, to the side of the tube 12. By providing two such handles 18 and 20, two users can easily carry the prop 10 by each grasping one of the handles 18 or 20.

Because such a prop 10 has a slenderness ratio (i.e., the ratio between its length and radius for a prop having a circular cross-section) that would generally cause such a structure to kneel or buckle along a central portion thereof when subjected to a longitudinal force, longitudinally extending support members 22 and 24 are attached to the outside surface 26 of the tube 12. The support members 22 and 24 are attached as by spot welds, such as welds 30–35, or may be welded by a continuous weld seam or bead. The support members 22 and 24 are formed from bent sections of flat steel, bent longitudinally along their length into an angle iron with radius configuration. The support members 22 and 24 are attached to the tube 12 along both longitudinal edges of each support member 22 and 24. The support members extend along a central portion 36 of the prop 10 to provide lateral structural support along a portion of the prop 10 to prevent buckling in the region 36 provided with such support members 22 and 24 (i.e., the laterally support region 36). The portions 38 and 40 that are left unsupported by the support members 22 and 24 provide yield or crush zones that allow for longitudinal yielding of the prop 10 along its length, while the support member 22 and 24 prevent buckling of the mine prop along the central portion 36. Thus, the longitudinal strength or its support capacity is such that the yield zones 38 and 40 will begin to yield before a buckling force in the central portion 36 is reached. Of course, the central portion 36 can be provided with lateral support that includes a safety factor to ensure that buckling does not occur in the central portion 36 before yielding in the crush zones 38 and 40 occurs.

The prop 10 may have a length of approximately five to eight feet (1.5 to 2.5 meters) or more and a diameter of approximately five to seven inches (12.7 to 17.8 cm) or more. The prop 10 is designed to carry an average load of at least approximately 80,000 lbs. and includes foamed concrete having density of approximately 60 to 70 lb/ft$^3$ and preferably between about 63 lb/ft$^3$ and 65 lb/ft$^3$ with a weight of approximately 15 to 20 pounds per linear foot.

The prop 10 also includes an end cap 42 that may be attached as by a weld 44 to one end 45 of the tube 12. The end cap is used to contain the foamed concrete when it is poured into the tube 12 during formation of the mine prop 10. In addition, the end cap, when positioned on the bottom of the prop 10 will keep any crushed concrete contained within the prop 10 during use.

Perforations 46 are circumferentially provided proximate one or both ends of the prop 10 in the crush zone 40 to allow for length adjustment of the prop 10 as needed. The perforations 46 allow one end 46 of the prop 10 to be broken away from the rest of the prop 10 to shorten the length of the prop 10 when a shorter length prop is desired. Each perforation 46 is comprised of a circumferential slot or channel that is formed as by cutting through the wall of the tube 12. A plurality of such slots or channels are separated by relatively small portions of the tube 12 that are left uncut and intact to hold the sections of the tube above and below the perforations 46 together. In practice, the prop 10 can be stricken by a blunt object such as a sledge hammer above the perforations 46 to sever the section above the perforation from the rest of the prop 10.

Figure 2:
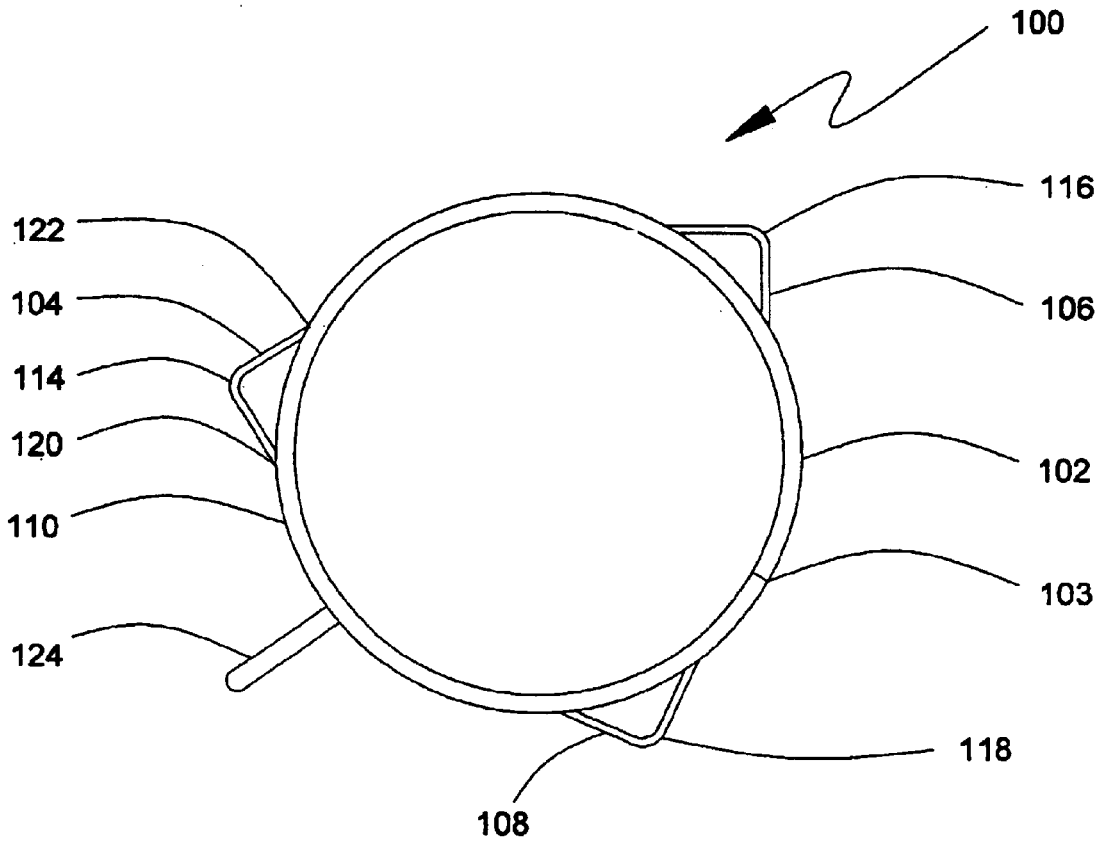
FIG. 2 is a top view of a second embodiment of a support prop in accordance with the principles of the present invention.

FIG. 2 illustrates a top view of a mine prop 100 in accordance with the principles of the present invention. The mine prop 100 is comprised of an outer tube 102 that is formed by sheet rolling techniques to form the tube 102 from a flat sheet of steel. Such steel may have a thickness of approximately 0.075 to 0.09 inches of 1008 steel. The tube 102 is then welded at the seam 103 along the entire length of the tube 102. Likewise, the tube 102 may be formed by an extrusion process or other methods known in the art. Buckling support members 104, 106 and 108 are attached, as by welding, to the outside surface 110 of the tube 102. The support member 104, 106 and 108 are approximately equally spaced around the circumference of the tube 102 so as to provide buckle resistant support in multiple radial directions. The support member 104, 106 and 108 are formed with rounded corners 114, 116 and 118, respectively, so as to present a smoother, less-sharp outer edge, compared to typical angle iron. Such rounded edges can help lessen the severity of an injury resulting from impact or other contact with the outer edge by a user. The support member 104, 106 and 108 are welded along each longitudinal edge, such as edges 120 and 122, to the tube 102. A handle 124 is also attached to the outside surface 110 of the tube 102.

Figure 3:
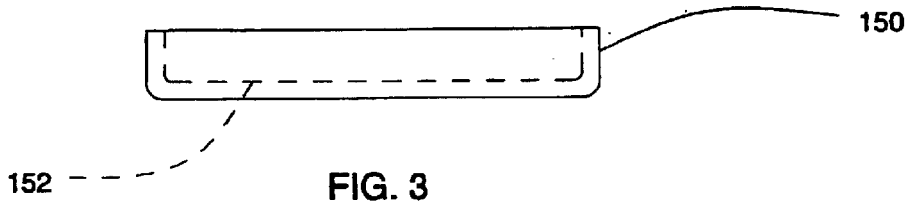
FIG. 3 is a side view of an end cap in accordance with the principles of the present invention.

FIG. 3 illustrates an end cap 150 for attaching to one end of the tube 102. The end cap 150 is configured to fit over one end of the tube 102 so that an end of the tube 102 fits within an inner portion 152 of the end cap 150. The end cap 150 may be held onto the end of the tube 102 by welding, interference fit or other methods of attachment known in the art. The end cap 150 may be placed on the bottom end of the prop 100 to prevent filler material from exiting the bottom end of the tube both during the manufacturing process and during use as the filler material at that end is crushed under load.

Figure 4:
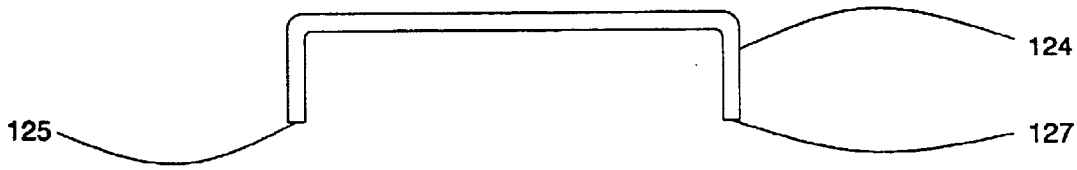
FIG. 4 is a side view of a handle in accordance with the principles of the present invention.
Figure 5:
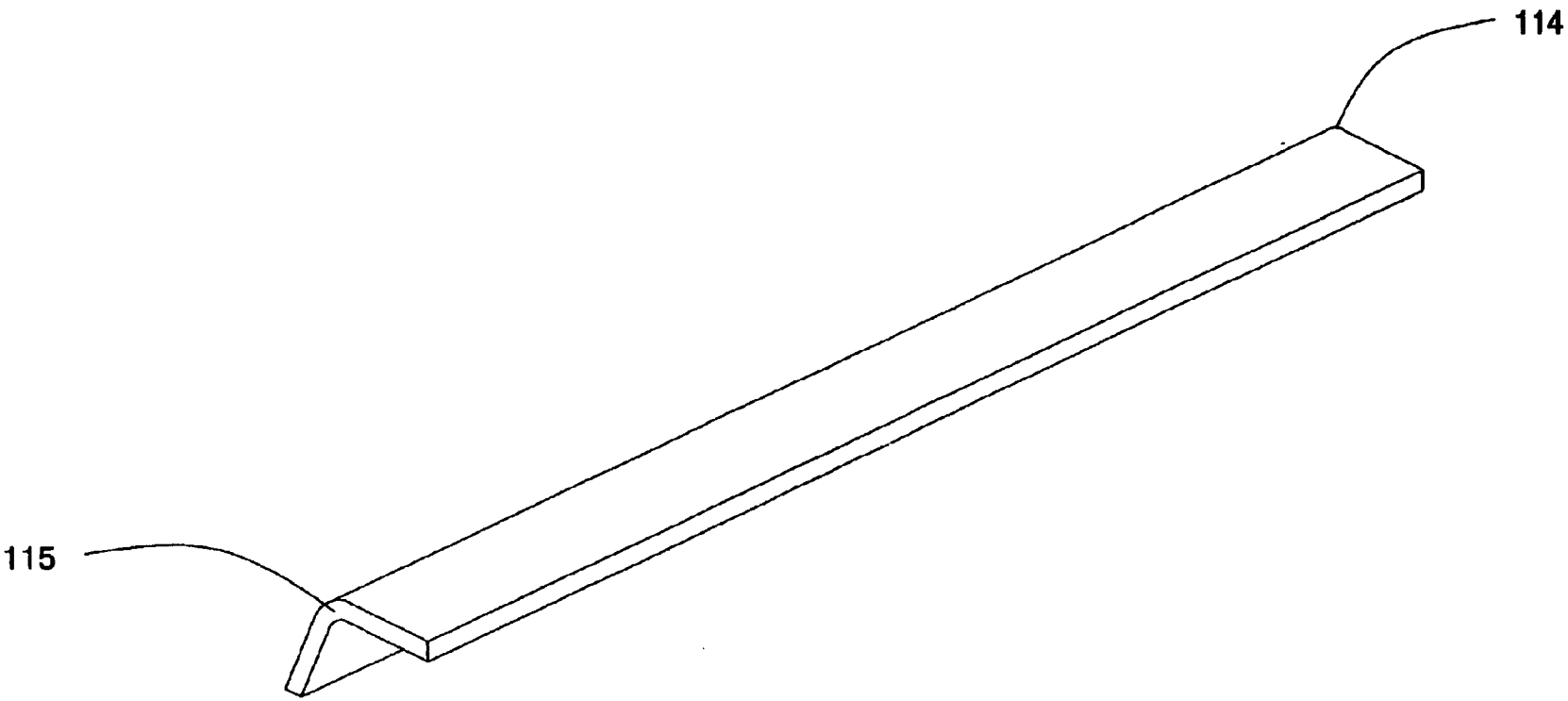
FIG. 5 is a perspective side view of a longitudinal support member in accordance with the principles of the present invention.

As shown in FIG. 4, the handle 124 is formed from a single section of solid material, such as steel rod, bent or otherwise formed into a "C" shape. The ends 125 and 127 of the handle 124 are attached to the tube 102 as by welding or other methods known in the art. For example, the handles 18 and 20 could be attached via a circumferentially extending strap or band or attached to one of the lateral support members 114, 116 or 118 or end cap 150.

In one embodiment, the support member 114 is comprised of an elongate section of flat steel material that is bent along its length at a central portion 115 to form an angled member that, by its shape, is resistant to lateral bending or buckling. The support member 114 thus has a generally V-shaped cross-section, with the longitudinal running ends of each leg of the V-shape being welded to the tube 102. The bend includes a radius to provide a rounded corner that extends the length of the lateral support. The support member 114 is attached to the tube 102 as previously described herein. The support member 114 provides sufficient lateral support to the tube 102 to prevent buckling while minimizing the amount of weight added to the prop to provide such support. Of course, those of skill in the art will appreciate that various other configurations may be employed for providing lateral support to the tube 102. For example, the support member 114 may be comprised of typical angle iron material. The thickness or gauge of the support member 114 may vary depending upon the slenderness ratio of the prop. For example, for longer props of a particular diameter, it may be necessary to prevent buckling or kneeling to increase the thickness of each support member 114 and thus in effect add additional reinforcement to the portion of the prop to which the support member is attached. Likewise, for shorter props of a given diameter, it may be acceptable to decrease the thickness of the support members, which also decreases the overall weight of the prop.

Figure 6:
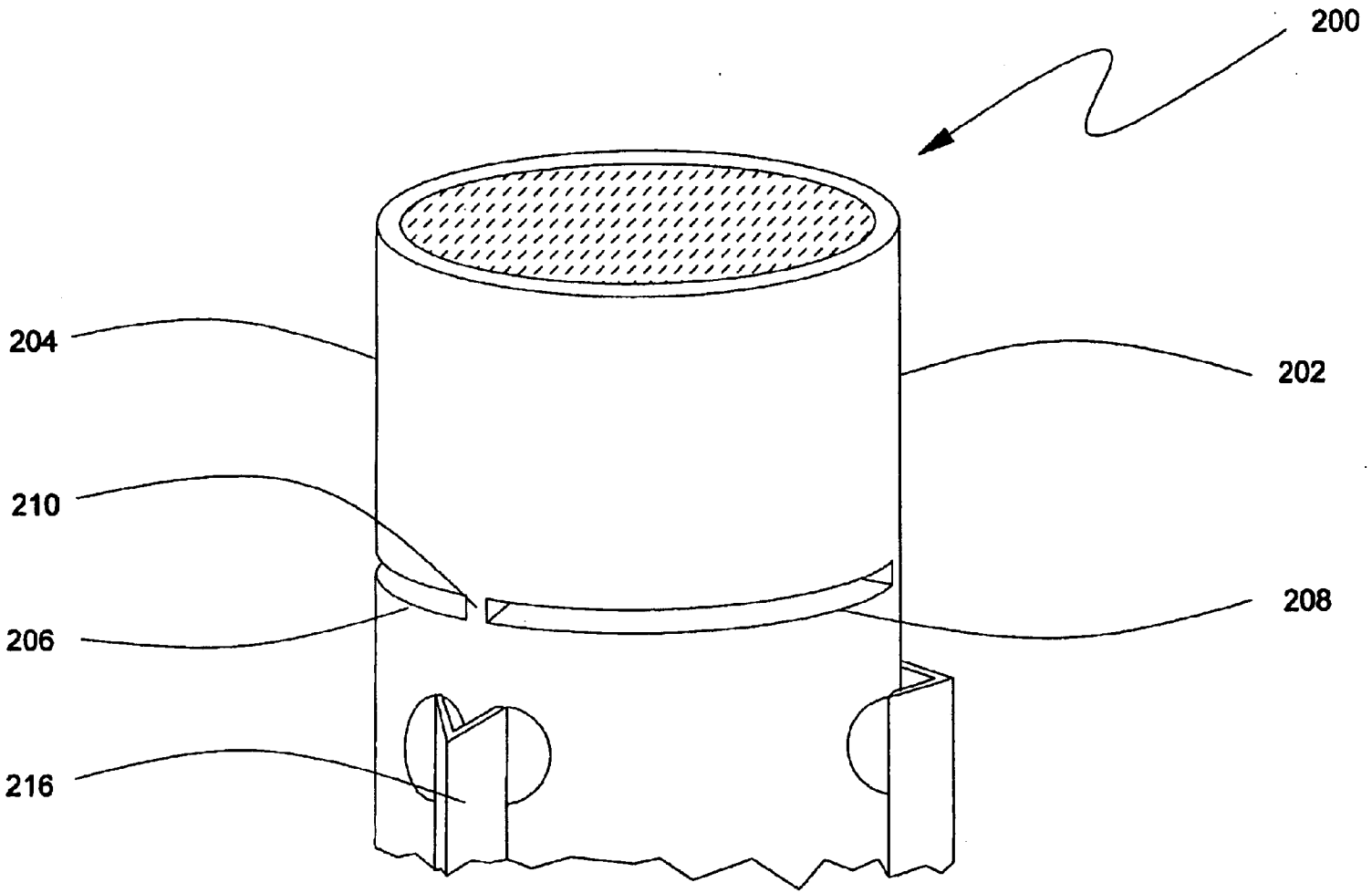
FIG. 6 is a partial perspective side view of a perforated end of a third embodiment of a support prop in accordance with the principles of the present invention.
Figure 7:
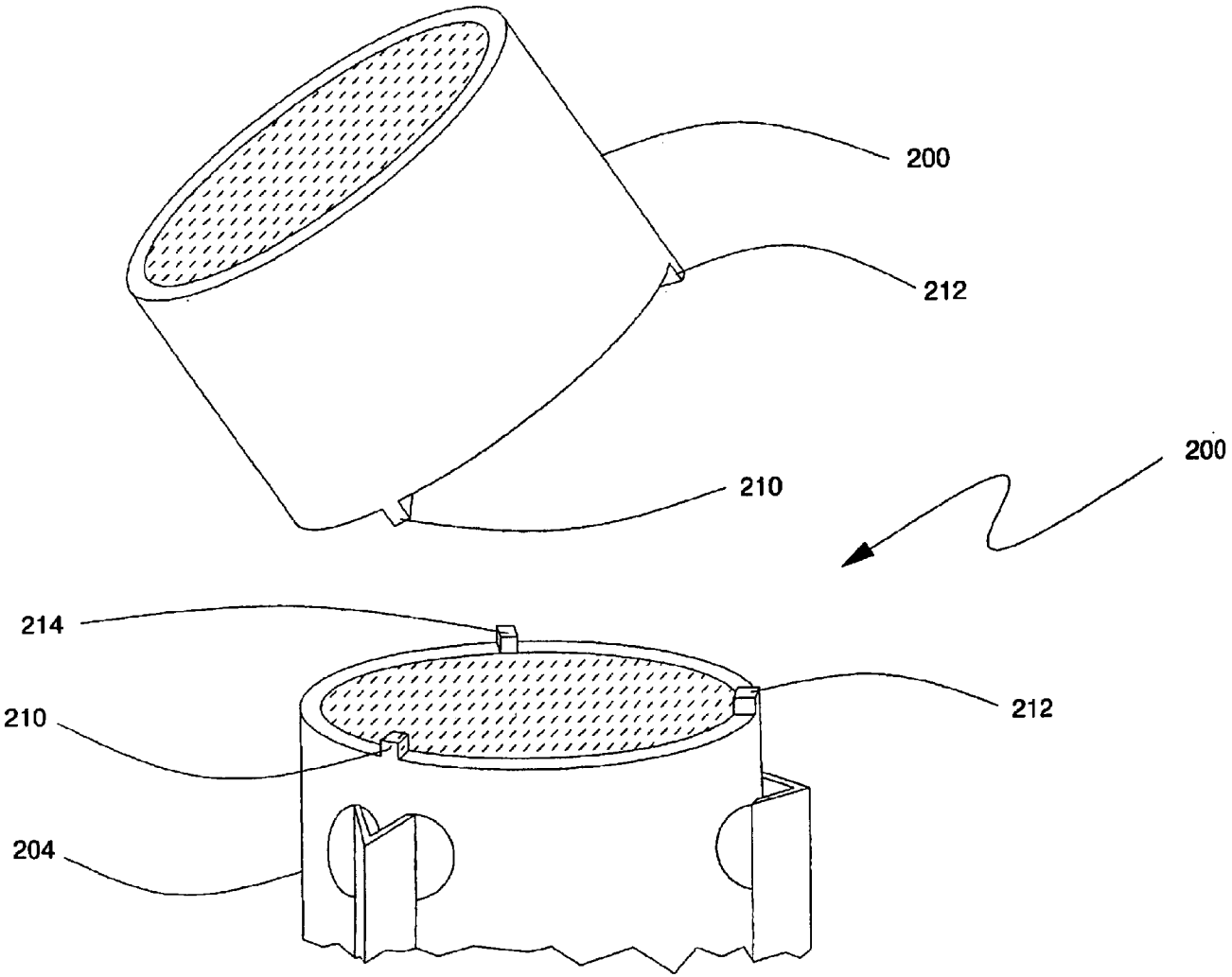
FIG. 7 is a partial perspective side view of the perforated end of the support prop shown in FIG. 6 in a severed state.

Referring now to FIGS. 6 and 7, there is illustrated one end 202 of a support prop, generally indicated at 200 in accordance with the principles of the present invention. The end portion 202 of the tube 204 is circumferentially perforated with a plurality of slots or slits 206 and 208 that extend through the wall of the tube 204. The perforation is provided at about six to eight inches from the end of the prop 200 to allow for six to eight inches of adjustment in the length of the prop 200 depending upon the location of the perforations. Relatively small connecting tabs 210, 212 and 214 are provided to maintain the structural integrity of the tube 204 when the prop 200 is used at its full length, but that can be relatively easily severed or broken to remove the end portion 202 from the remainder of the prop 200 to shorten its length as desired. The connecting tabs 210, 212 and 214 may be provided in number and positioned to longitudinally align with each support member 216. Of course, more or less perforations may be provided as desired. As further illustrated in FIG. 7, a lateral blow to the top portion of the prop 200 will sever the top portion from the remainder or lower section of the prop. It may be necessary to provide repeated lateral blows at the approximate locations of each tab 210, 212 and 214 in order to sever each tab and remove the top portion.

Figure 8:
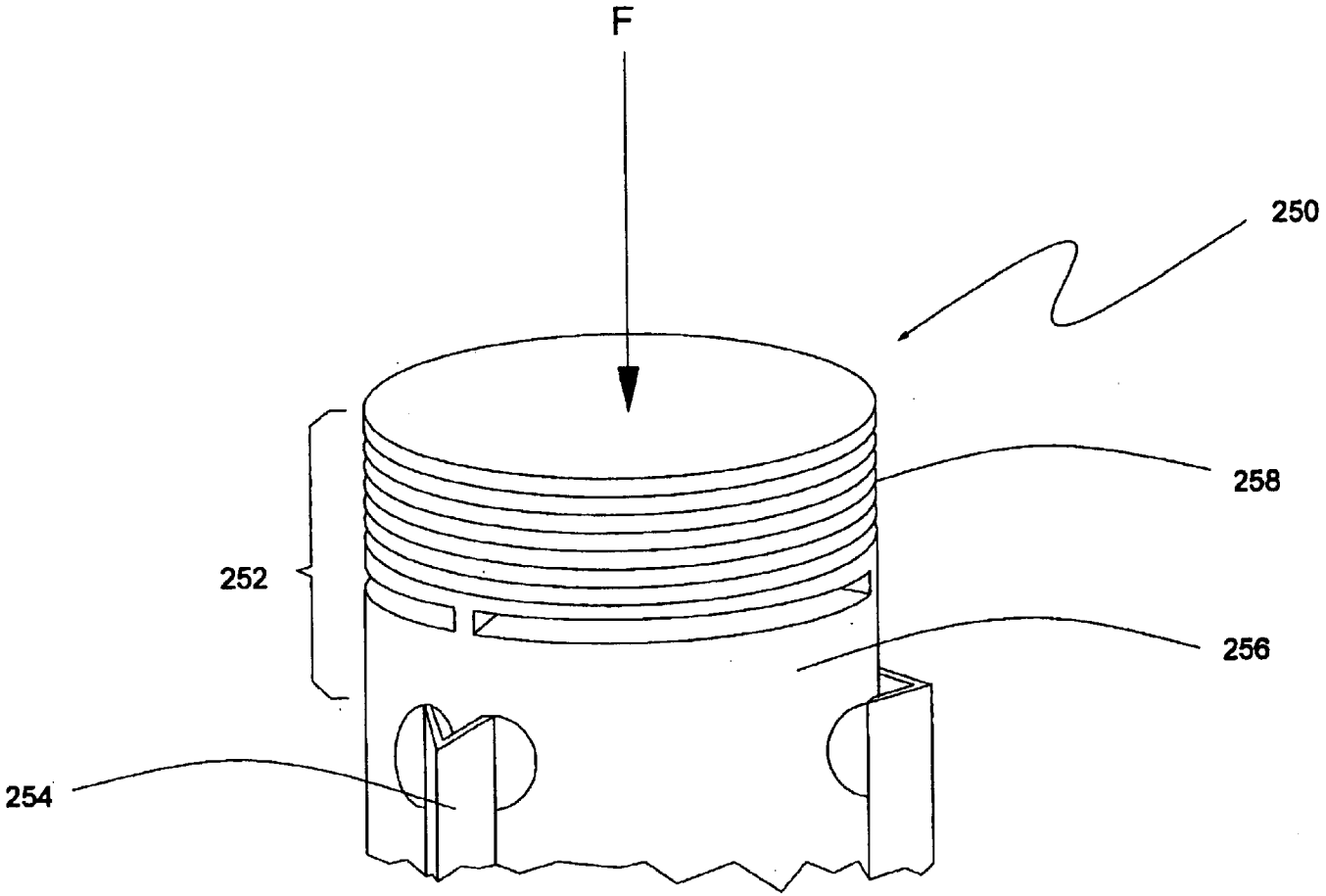
FIG. 8 is a partial perspective side view of a fourth embodiment of a support prop in accordance with the principles of the present invention in a partially yielded state.

As shown in FIG. 8, a mine prop generally indicated at 250 will longitudinally yield when subjected to a longitudinal force F. The prop 250 will yield in the yield zone 252 above the support member 254 by allowing the outer tube 256 to fold upon itself in a plurality of folds 258 as the filler material (not shown) compresses. Thus, the mine prop 250 longitudinally yields without releasing the load. The yield zone 252 may be approximately one foot in length with two such yield zones provided in each prop 250, one on each end. Thus the yield zones comprise approximately one quarter to one third of the entire length of the prop 250.

Figure 9:
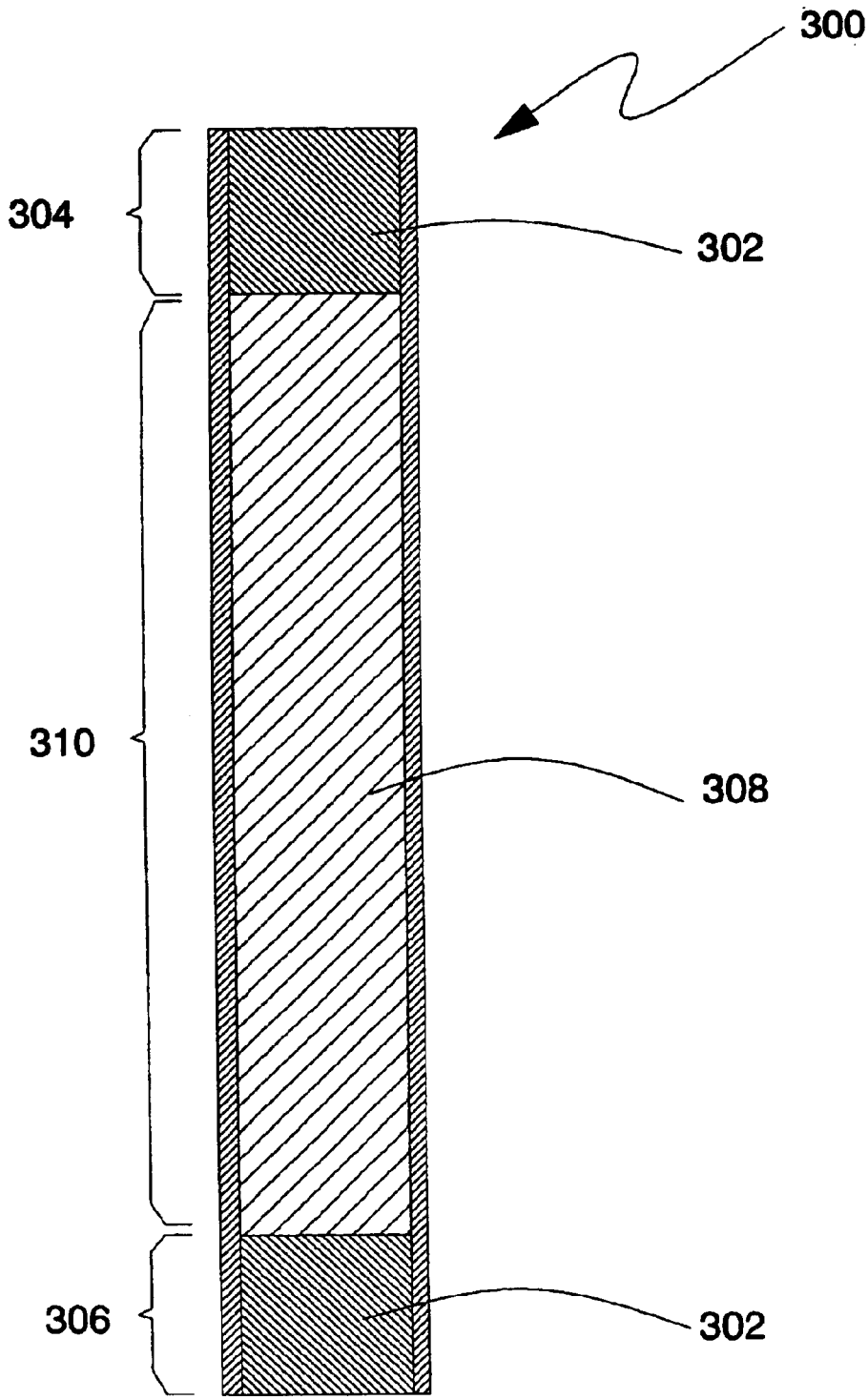
FIG. 9 is a cross-sectional side view of a fifth embodiment of a support prop in accordance with the principles of the present invention.
Figure 10:
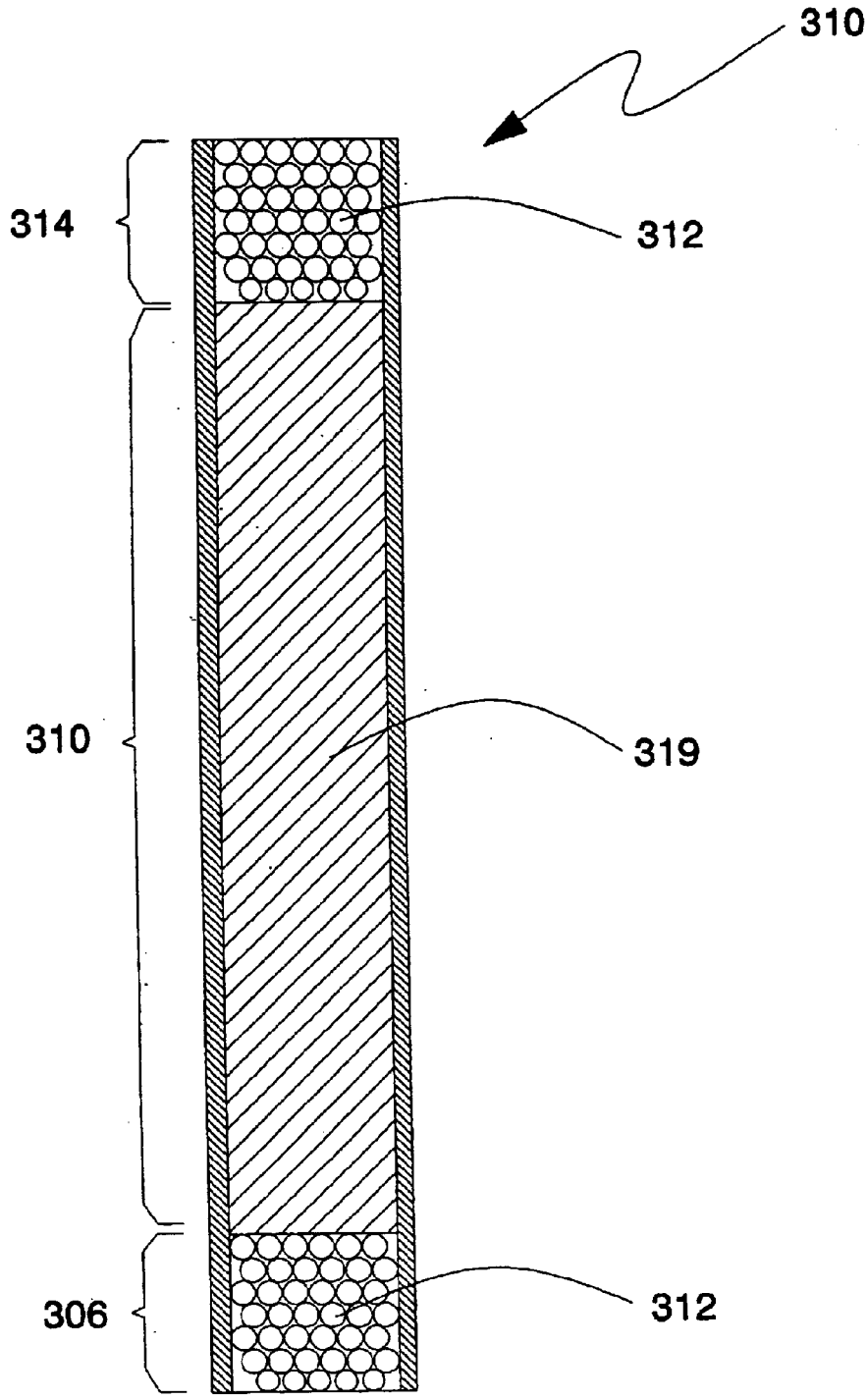
FIG. 10 is a cross-sectional side view of a sixth embodiment of a support prop in accordance with the principles of the present invention.
Figure 11:
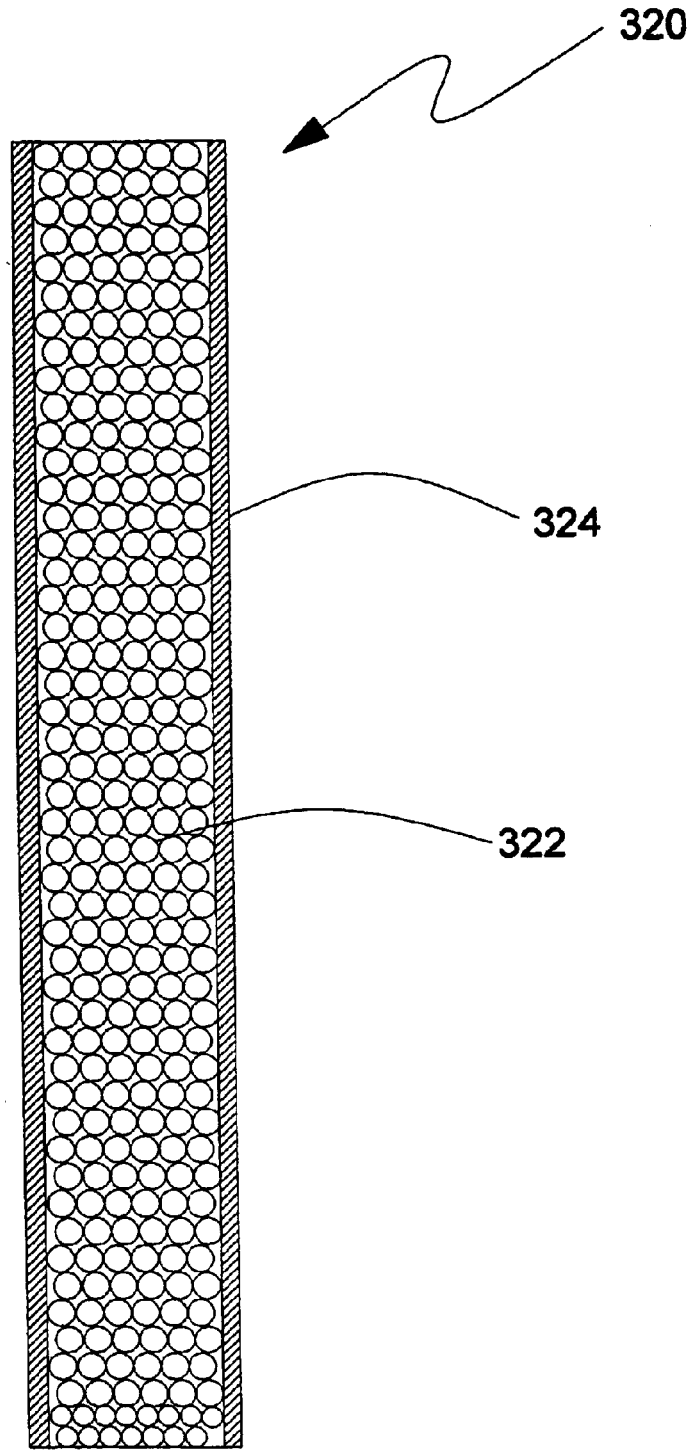
FIG. 11 is a cross-sectional side view of a seventh embodiment of a support prop in accordance with the principles of the present invention.

As illustrated in FIGS. 9, 10 and 11, various fillers and combinations of fillers may be employed in the mine props. For example, as shown in FIG. 9, the mine prop 300 may include a more compressive filler material 302 in the yield zones 304 and 306 than the filler material 308 in the buckling resistant zone 310. For example, the filler material 308 may comprise a solid concrete while the filler material 302 may comprise wood, saw dust or aerated concrete. Similarly, the filler material 308 may comprise a more dense aerated concrete than aerated concrete provided in the yield zones 304 and 306.

Likewise, the post 310 shown in FIG. 10 may include compressible filler 312, such as pumas or hollow glass spheres, in the crush zones 314 and 316 while the buckling resistant zone 318 is filled with a less yield resistant material 319 that is less susceptible to buckling.

In FIG. 11, the entire length of the mine prop 320 is filled with a particulate type filler, such as pumas, saw dust or other generally loose filler material 322. In order to limit or prevent settling of such filler materials 322, a binding agent or material may be added to the filler material 322 to hold the filler material 322 together and to the inside of the tube 324.

Figure 12:
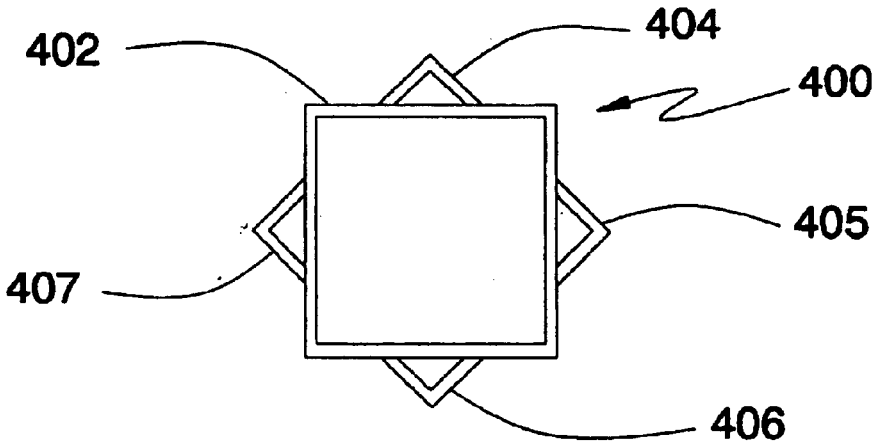
FIG. 12 is a cross-sectional end view of a eighth embodiment of a support prop in accordance with the principles of the present invention.
Figure 13:
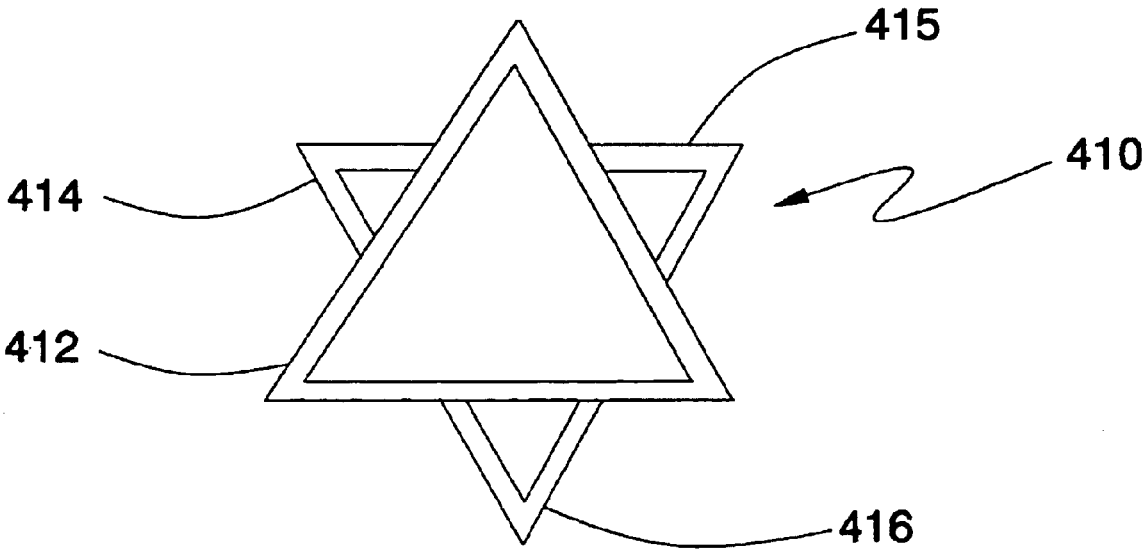
FIG. 13 is a cross-sectional end view of a ninth embodiment of a support prop in accordance with the principles of the present invention.
Figure 14:
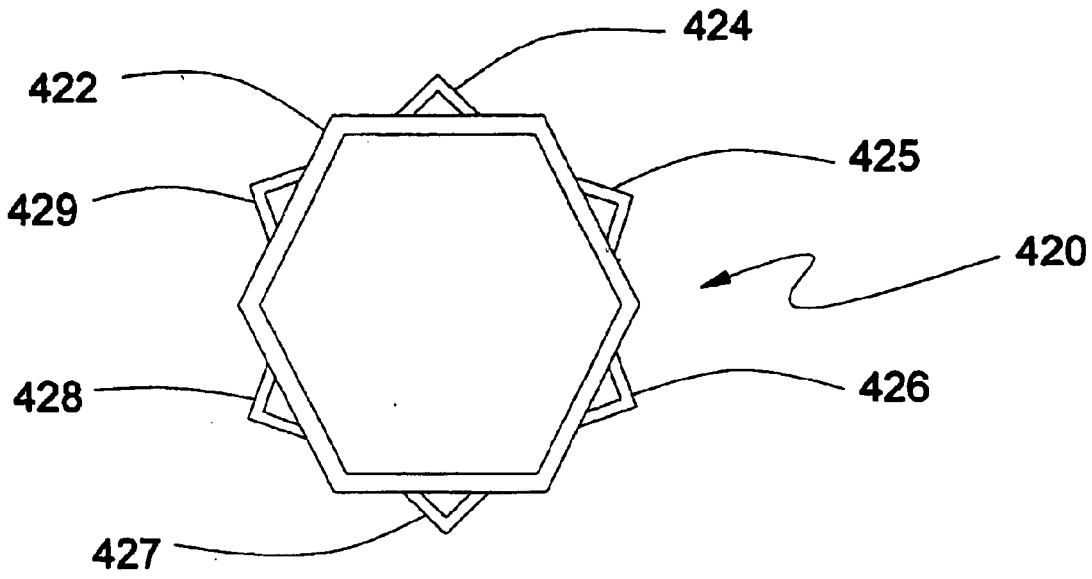
FIG. 14 is a cross-sectional end view of a tenth embodiment of a support prop in accordance with the principles of the present invention.
Figure 15:
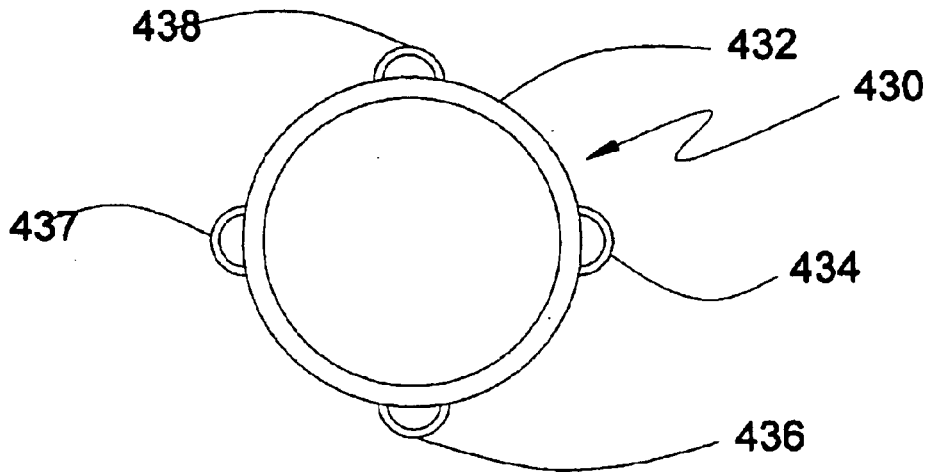
FIG. 15 is a cross-sectional end view of a eleventh embodiment of a support prop in accordance with the principles of the present invention.

As shown in FIGS. 12–15, a support prop in accordance with the principles of the present invention may be configured in various cross-sectional configurations to provide longitudinal yieldability while providing sufficient lateral support to resist buckling. As shown in FIG. 12, the post 400 includes a square tube 402 with angled support members 404–407. In FIG. 13, the support post 410 is provided with a triangular tube 412 with angled lateral support members 414–416. In FIG. 14, the tube 422 of the support post 420 is hexagonal in cross-section with angled support members 424–429 provided along each flat side of the hexagonally-shaped tube 422. As shown in FIG. 15, a round tube 432 of a support post 430 is provided with four half-round support members 434–438. Thus, while many of the embodiments illustrated herein have been shown as a generally round tube with three support members of angled configuration, it is understood that variously configured tubes can be provided with variously configured support members in various numbers.

Figure 16A:
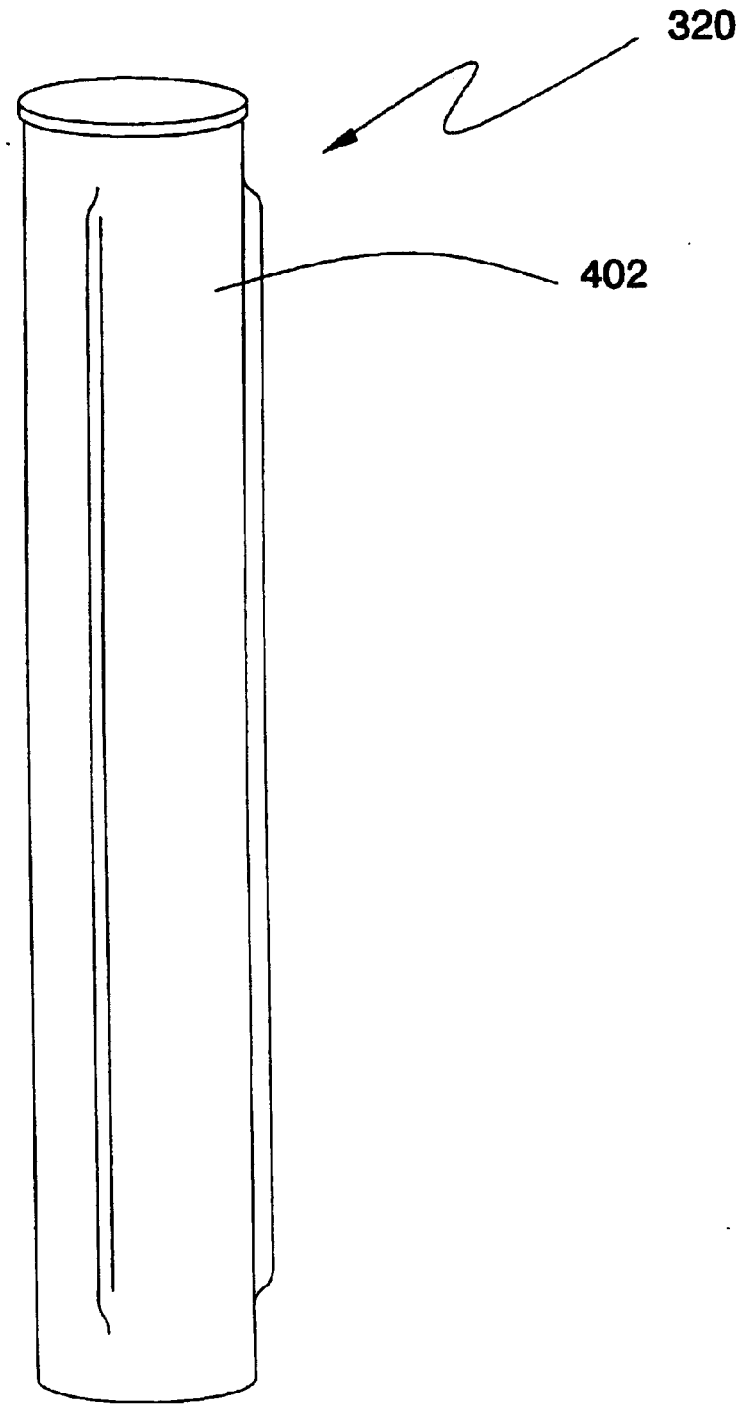
FIGS. 16A and 16B are a side perspective view and a cross-sectional end view, respectively, of a twelfth embodiment of a support prop in accordance with the principles of the present invention.
Figure 16B:
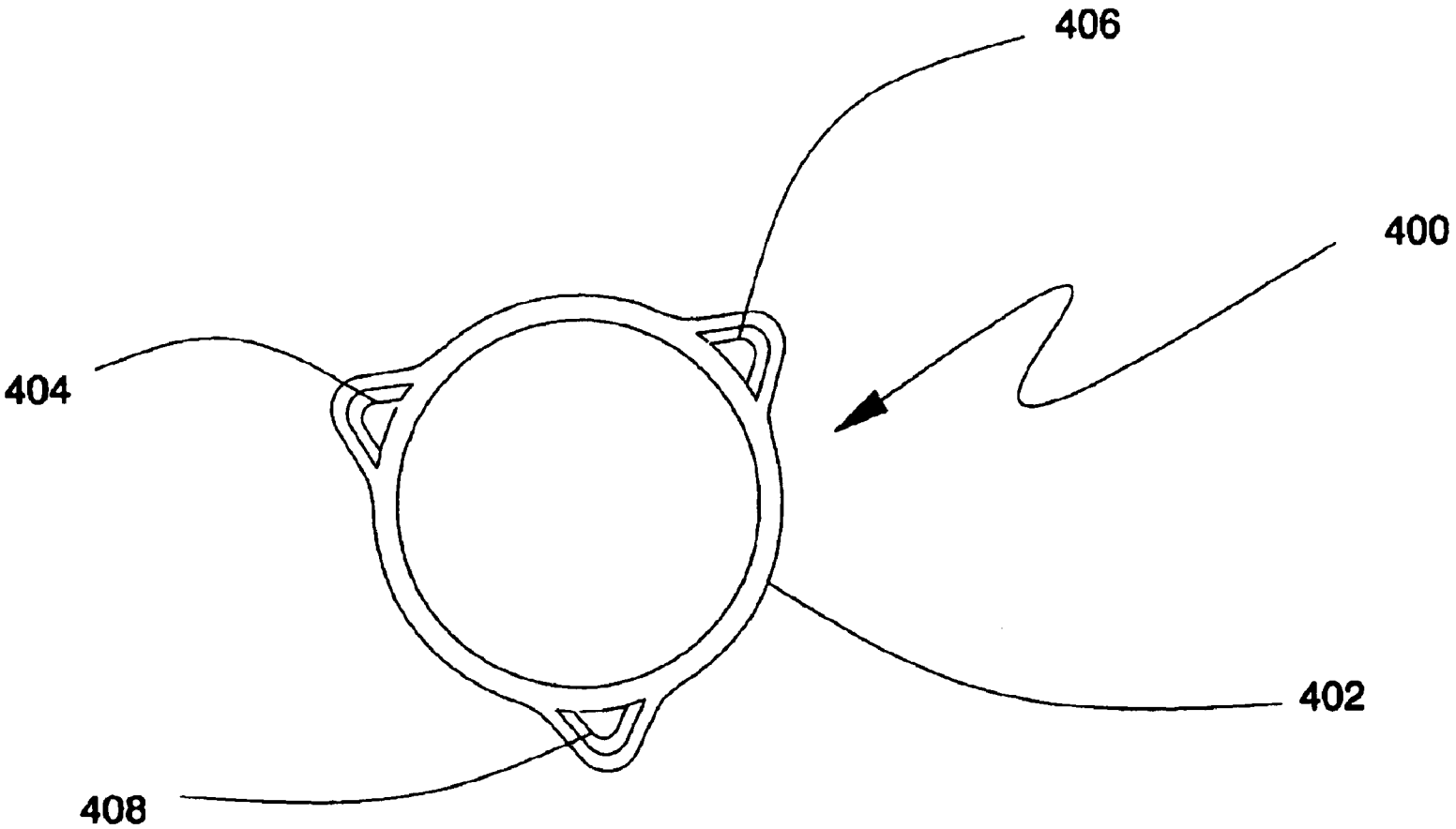

Referring now to FIGS. 16A and 16B, a support post, generally indicated at 400 in accordance with the principles of the present invention, is formed from a composite tube 402 with internal longitudinally extending, lateral support members 404, 406 and 408. The tube may be formed by filament winding, fiberglass formation, molding, extrusion or other methods known in the art with the support members 404, 406 and 408 formed therein with the composite material extending over the support members. Circumferential bands or rings (not shown) may also be provided to provide adequate hoop strength to the support members 404, 406 and 408 in order to prevent radial bulging or expansion of the support post 400 under load.

Figure 17:
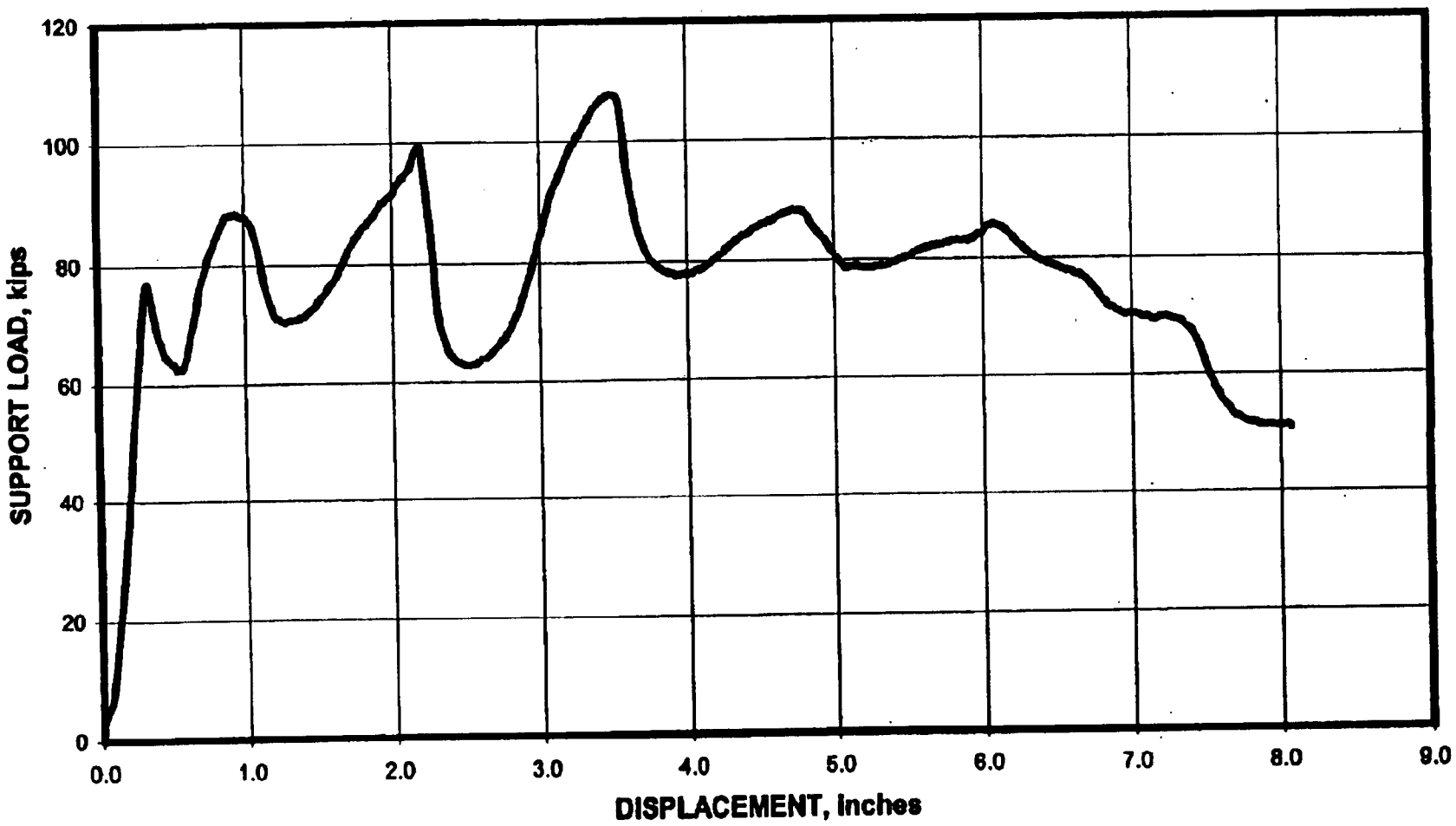
FIG. 17 is a first graphical representation of test results illustrating support load versus displacement for a support prop according to the present invention.
Figure 18:
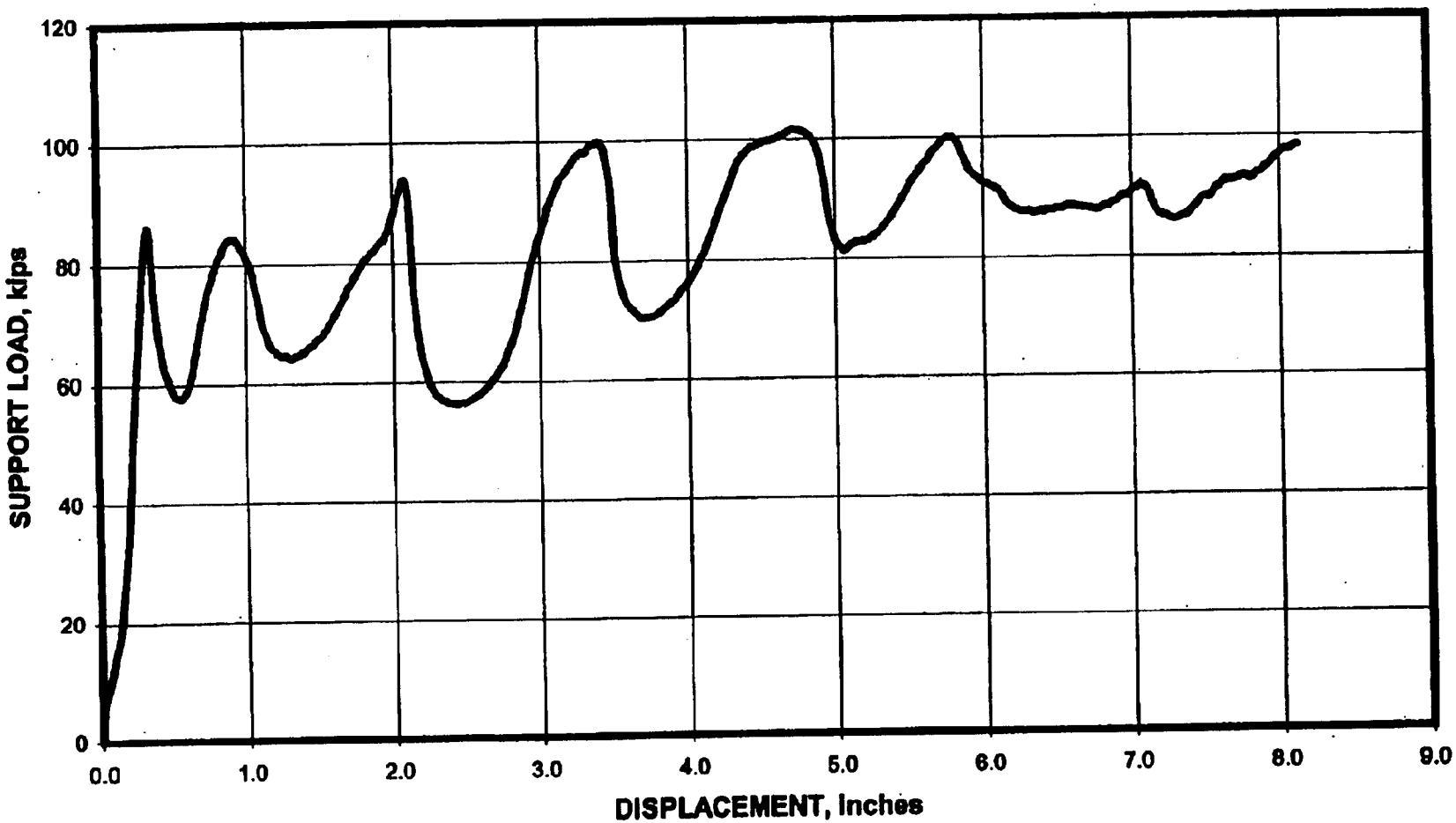
FIG. 18 is a second graphical representation of test results illustrating support load versus displacement for a support prop according to the present invention.
Figure 19:
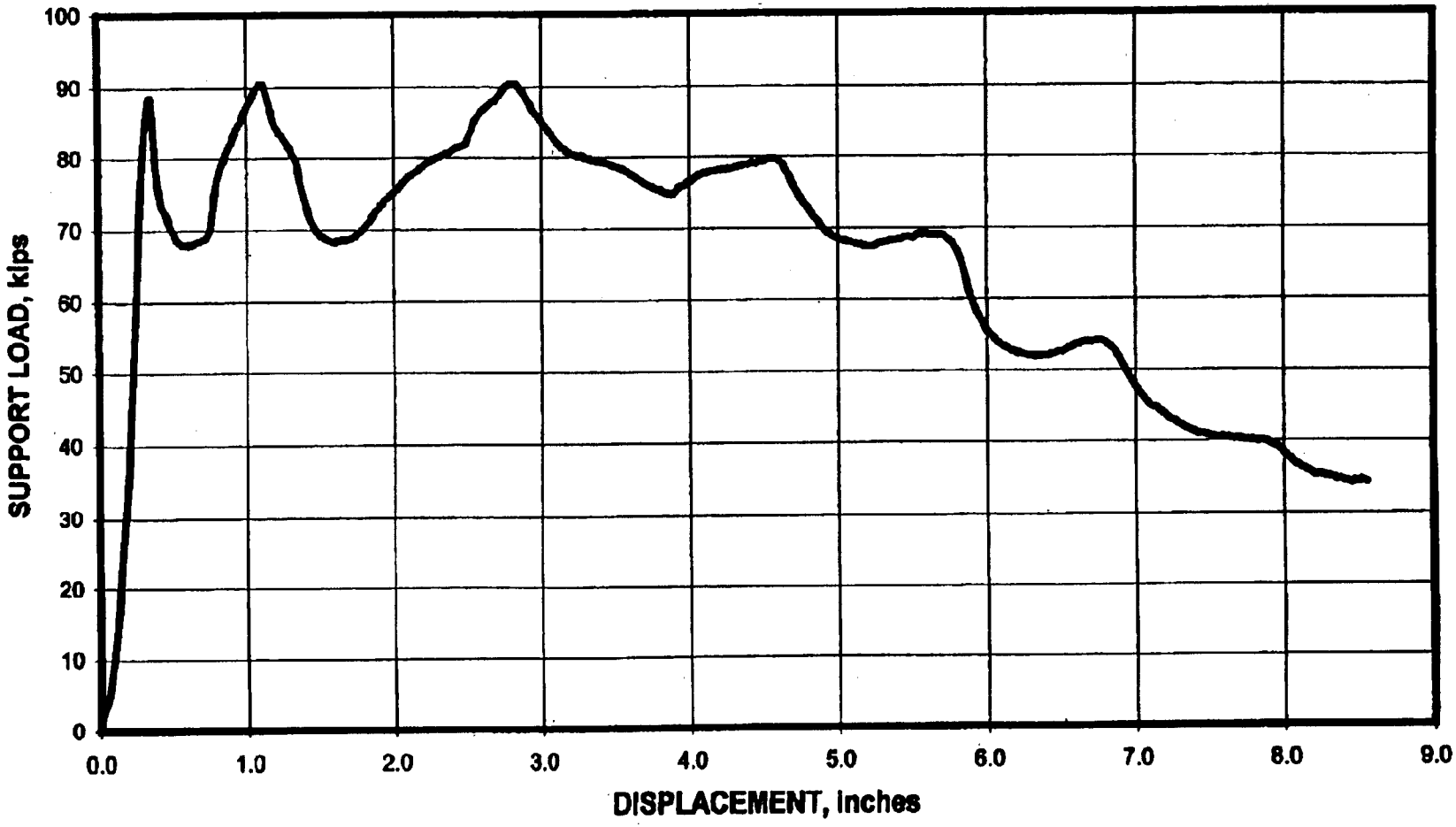
FIG. 19 is a first graphical representation of test results illustrating support load versus displacement for a support prop according to the present invention.

By way of example of the loads that can be supported by a mine prop in accordance with the present invention, several tests have illustrated the impressive load supporting capabilities of the mine prop in accordance with the present invention. FIGS. 17, 18 and 19 are graphical representations of actual test results conducted at the NIOSH Safety Structures Testing Laboratory. FIG. 17 shows the test results for a mine prop in accordance with the present invention comprised of aerated concrete having a density of 65 lbs/ft$^3$, a total weight of 127 lbs. The mine prop had a six inch diameter and was 6.5 feet in length. The outer shell of the mine prop was comprised of 0.081 gauge steel. The graph of FIG. 17 represents the applied load (in kips) versus displacement (in inches). The displacement is the amount of vertical or longitudinal yielding of the support prop as the longitudinal load or force is applied to the prop. As shown, during the initial loading during the first inch of displacement, the prop rapidly picks up the load. The mine prop supports approximately 78 kips before beginning to yield. As the yielding section of the mine prop begins to yield, the support load decreases to approximately 62 kips. The mine prop continues to support the load with the support load cycling through load/yield cycles as the outer shell of the yieldable portion of the mine prop folds upon itself as illustrate in FIG. 8. The mine prop continues to support a load above 60 kips until more than seven inches of displacement have occurred.

In FIG. 18, the mine prop tested in accordance with the present invention was of the same mix density and dimensions as the mine prop tested with reference to FIG. 17. In this test, the mine prop supported a load of over 80 kips even after eight inches of displacement. Again, the support load cycled up and down as the yieldable portion folded upon itself, but did not support less than about 57 kips and supported loads of between 80 and 100 kips.

FIG. 19 illustrates the test results of a mine prop according to the present invention having a mix density and dimensions the same as the mine props tested as shown in FIGS. 17 and 18. The test conducted with reference to FIG. 19, however, simulated a mine condition in which the floor or ceiling of the mine shifts such that the mine prop is subjected to horizontal displacement as well as vertical displacement. In the test conducted with reference to FIG. 19, for each three inches of vertical displacement the mine prop was subjected to one inch of horizontal displacement. As such, the forces and stresses experienced by the mine prop are not completely vertical in nature with lateral forces resulting from the horizontal displacement condition. Again, the mine prop according to the present invention maintained a support load of between about 70 kips and 90 kips during the first five inches of vertical displacement. In addition, the mine prop continued to support over 30 kips even after eight inches of vertical displacement and nearly three inches of horizontal displacement. Thus, even in a condition where horizontal shifting of the mine roof or floor occurs, the mine prop according to the present invention continues to support significant loads.

While the present invention has been described with reference to certain illustrative embodiments to illustrate what is believed to be the best mode of the invention, it is contemplated that upon review of the present invention, those of skill in the art will appreciate that various modifications and combinations may be made to the present embodiments without departing from the spirit and scope of the invention as recited in the claims. It should be noted that reference to the term "tube" in the claims is intended to cover tubes of all cross-sectional configurations including, without limitation, round, square, and other geometric shapes. In addition, reference herein to a "mine prop" according to the present invention is not intended in any way to limit the usage of the prop of the present invention. Indeed, the mine prop of the present invention may have particular utility in various tunnel systems or other applications where a yieldable support post is desired. The claims provided herein are intended to cover such modifications and combinations and all equivalents thereof. Reference herein to specific details of the illustrated embodiments is by way of example and not by way of limitation.

What is claimed is:

1. A longitudinally yieldable support prop, comprising:

an elongate tube;

a plurality of elongate support members, each having a length that is less than a length of said elongate tube, attached to said elongate tube along a length thereof to substantially prevent kneeling or buckling of said elongate tube along the portion of said elongate tube to which said plurality of elongate support members are attached, said plurality of elongate support members defining a laterally supported region and at least one yieldable region proximate at least one end of said elongate tube; and a compressible filler material disposed within at least one portion of said elongate tube to allow supported yielding in said at least one yieldable region.

2. The longitudinally yieldable support prop of claim 1, wherein said elongate tube has a slenderness ratio that would generally allow buckling or kneeling before axial yielding of the elongate tube of the elongate tube when exposed to a sufficient axial force.

3. The longitudinally yieldable support prop of claim 1, wherein said compressible filler material has a compressive strength that is less than the buckling or kneeling limit of said laterally supported region.

4. The longitudinally yieldable support prop of claim 1, wherein said yieldable region is capable of supporting a load of at least 50,000 lbs. as the yieldable region yields under load.

5. The longitudinally yieldable support prop of claim 1, wherein said yieldable region is capable of supporting an average load of approximately 80,000 pounds as the yieldable region yields under load.

6. The longitudinally yieldable support prop of claim 1, wherein said elongate tube is comprised of steel.

7. The longitudinally yieldable support prop of claim 6, wherein said compressible filler material is comprised of lightweight concrete.

8. The longitudinally yieldable support prop of claim 7, wherein said compressible filler material is comprised of aerated concrete.

9. The longitudinally yieldable support prop of claim 8, wherein said aerated concrete has a density of approximately between about 60 and 70 lb/ft$^3$.

10. The longitudinally yieldable support prop of claim 1, wherein said plurality of elongate support members are comprised of angled members of steel.

11. The longitudinally yieldable support prop of claim 10, wherein said elongate tube is comprised of steel and said plurality of elongate support members are welded to said elongate tube.

12. The longitudinally yieldable support prop of claim 1, wherein said elongate tube has a circular cross-section and said plurality of elongate support members are approximately equally spaced about said elongate tube.

13. The longitudinally yieldable support prop of claim 1, wherein said plurality of elongate support members comprise at least three elongate support members.

14. The longitudinally yieldable support prop of claim 1, further including at least one handle coupled to said elongate tube for grasping by a user.

15. The longitudinally yieldable support prop of claim 1, further including at least one end cap coupled to at least one end of said elongate tube.

16. The longitudinally yieldable support prop of claim 1, wherein said elongate tube will yield upon itself in a plurality of folds within said at least one yieldable region as said yieldable region yields axially under load.

17. The longitudinally yieldable support prop of claim 1, further including at least one circumferential perforation formed in said elongate tube proximate at least one end of said elongate tube to allow length adjustment of said elongate tube.

18. A longitudinally yieldable support prop, comprising:

an elongate tube having a first end and a second end;

a lightweight concrete disposed within said elongate tube and substantially filling said elongate tube between said first end and said second end of said elongate tube; and a plurality of elongate support members each having a first end and a second end and each longitudinally extending along and attached to said elongate tube, said first end of each of said plurality of elongate support members being spaced from said first end of said elongate tube and said second end of each of said plurality of elongate support members being spaced from said second end of said elongate tube to form a yieldable portion of said elongate tube at each of said first end second ends thereof.

19. The longitudinally yieldable support prop of claim 18, wherein said lightweight concrete is comprised of aerated concrete.

20. The longitudinally yieldable support prop of claim 18, wherein said elongate tube and said plurality of elongate support members are comprised of steel.

21. The longitudinally yieldable support prop of claim 18, wherein said elongate tube and said lightweight concrete work in tandem to support a load and yield together within said yieldable portion.

22. The longitudinally yieldable support prop of claim 18, wherein said plurality of elongate support members prevent longitudinal yielding and buckling or kneeling of said elongate tube along a portion of said elongate tube to which the plurality of elongate support members are attached while said yieldable portion is yielding.

23. The longitudinally yieldable support prop of claim 18, wherein said plurality of elongate support members are generally V-shaped in cross-section with each leg of the elongate support members being welded to the elongate tube.

24. The longitudinally yieldable support prop of claim 18, wherein a force required to cause longitudinal yielding of said elongate tube and said lightweight concrete is less than a force required to cause buckling or kneeling of The longitudinally yieldable support prop.

25. The longitudinally yieldable support prop of claim 18, wherein said elongate tube has a slenderness ratio that would generally allow buckling or kneeling before axial yielding of the elongate tube when subjected to a sufficient axial force.

26. The longitudinally yieldable support prop of claim 18, wherein said lightweight concrete has a compressive strength that is less than the buckling or kneeling limit of said laterally supported region.

27. The longitudinally yieldable support prop of claim 18, wherein said yieldable portion is capable of supporting a load of at least 50,000 lbs. as the yieldable portion yields under load.

28. The longitudinally yieldable support prop of claim 18, wherein said yieldable portion is capable of supporting an average load of approximately 80,000 pounds as the yieldable region yields under load.

29. The longitudinally yieldable support prop of claim 18, wherein said elongate tube has a circular cross-section and said plurality of elongate support members are approximately equally spaced about said elongate tube.

30. The longitudinally yieldable support prop of claim 18, wherein said plurality of elongate support members comprise at least three elongate support members.

31. The longitudinally yieldable support prop of claim 18, further including at least one handle coupled to said elongate tube for grasping by a user.

32. The longitudinally yieldable support prop of claim 18, further including at least one end cap coupled to at least one end of said elongate tube.

33. The longitudinally yieldable support prop of claim 18, wherein said lightweight concrete has a density of approximately between about 60 and 70 $lb/ft^3$.

34. The longitudinally yieldable support prop of claim 18, wherein said elongate tube will yield upon itself in a plurality of folds within said yieldable portion as said yieldable portion yields axially under load.

35. The longitudinally yieldable support prop of claim 18, further including at least one handle coupled to said elongate tube for grasping by a user and for carrying The longitudinally yieldable support prop.

36. The longitudinally yieldable support prop of claim 18, further including at least one circumferential perforation formed in said elongate tube proximate at least one end of said elongate tube to allow length adjustment of said elongate tube.

* * * * *